US010000942B2

(12) United States Patent
Hanson

(10) Patent No.: US 10,000,942 B2
(45) Date of Patent: Jun. 19, 2018

(54) COLLAPSIBLE ALL-TERRAIN COT OR TENT APPARATUS

(71) Applicant: Alfred Hanson, Charlottesville, VA (US)

(72) Inventor: Alfred Hanson, Charlottesville, VA (US)

(73) Assignee: AKZ Designs, LLC, Charlottesville, VA (US)

( * ) Notice: Subject to any disclaimer, the term of this patent is extended or adjusted under 35 U.S.C. 154(b) by 0 days. days.

(21) Appl. No.: 15/423,532

(22) Filed: Feb. 2, 2017

(65) Prior Publication Data

US 2017/0218654 A1 Aug. 3, 2017

Related U.S. Application Data

(60) Provisional application No. 62/290,312, filed on Feb. 2, 2016.

(51) Int. Cl.

| | |
|---|---|
| ***E04H 15/02*** | (2006.01) |
| ***A45F 3/22*** | (2006.01) |
| ***A47C 17/64*** | (2006.01) |
| ***A47C 29/00*** | (2006.01) |
| ***E04H 15/04*** | (2006.01) |
| ***E04H 15/30*** | (2006.01) |

(Continued)

(52) U.S. Cl.

CPC ..... *E04H 15/02* (2013.01); *A47C 17/645* (2013.01); *A47C 29/003* (2013.01); *E04H 15/04* (2013.01); *E04H 15/30* (2013.01); *E04H 15/34* (2013.01); *E04H 15/54* (2013.01); *E04H 15/58* (2013.01); *E04H 15/64* (2013.01)

(58) Field of Classification Search

CPC ..... E04H 15/04; E04H 15/02; E04H 15/32; E04H 15/34; E04H 15/56; E04H 15/324; A45F 4/08; A45F 2003/025; A47C 17/84; A47C 29/003

USPC ..... 135/90, 95, 96, 123, 120.4, 151, 156, 135/116, 119; 5/120–121, 126–128

See application file for complete search history.

(56) References Cited

U.S. PATENT DOCUMENTS

| | | | | |
|---|---|---|---|---|
| 33,678 A * | 11/1861 | Forbush | ..... | A47C 3/0255 5/122 |
| 1,023,048 A | 4/1912 | Snyder | | |
| 1,260,845 A * | 3/1918 | Winder | ..... | A47C 17/64 135/95 |

(Continued)

FOREIGN PATENT DOCUMENTS

| | | |
|---|---|---|
| FR | 949191 A | 8/1949 |
| GB | 13369 A | 5/1915 |

OTHER PUBLICATIONS

Co-Pending International Application No. PCT/US2017/016283 filed Feb. 2, 2017, Written Opinion of the International Searching Authority, dated Apr. 28, 2017, 3 pages.

(Continued)

*Primary Examiner* — Winnie Yip

(74) *Attorney, Agent, or Firm* — Woods Rogers PLC; Nathan A. Evans

(57) ABSTRACT

The present invention is directed to a lightweight, packable, all-terrain cot, tent or other apparatus that is designed to fit a multitude of configurations for use in different terrain situations. The apparatus is uniquely supported by a series of arch rods, tail and head bars, and sets of cables, that provide support for weight placed on the apparatus in a variety of environments regardless of whether the setting for said apparatus is a flat surface.

15 Claims, 7 Drawing Sheets

(51) Int. Cl.

| | |
|---|---|
| ***E04H 15/34*** | (2006.01) |
| ***E04H 15/54*** | (2006.01) |
| ***E04H 15/58*** | (2006.01) |
| ***E04H 15/64*** | (2006.01) |

(56) References Cited

U.S. PATENT DOCUMENTS

| | | | | | |
|---|---|---|---|---|---|
| 2,284,900 | A * | 6/1942 | Henderson | A45F 3/22 | 5/122 |
| 2,375,792 | A * | 5/1945 | Kearny | A45F 3/22 | 5/121 |
| 3,359,576 | A * | 12/1967 | Pile | A61G 7/00 | 5/111 |
| 3,730,407 | A | 5/1973 | Russell | | |
| 4,001,902 | A * | 1/1977 | Hall | A45F 3/22 | 5/121 |
| 4,320,542 | A * | 3/1982 | Cohen | E04H 15/04 | 5/121 |
| 4,459,713 | A * | 7/1984 | Fry | A47C 17/66 | 5/110 |
| 6,098,218 | A * | 8/2000 | Ventura | A47C 29/006 | 135/91 |
| 6,134,727 | A | 10/2000 | Hwang | | |
| 6,220,264 | B1 * | 4/2001 | Newman | E04H 15/04 | 135/115 |
| 6,347,638 | B1 * | 2/2002 | Scott | E04H 15/04 | 135/115 |
| 6,353,946 | B1 * | 3/2002 | Steiner | A45B 3/00 | 5/120 |
| 2007/0022530 | A1 * | 2/2007 | Gadd | A47C 29/006 | 5/114 |

OTHER PUBLICATIONS

Co-Pending International Application No. PCT/US2017/016283 filed Feb. 2, 2017, International Search Report, dated Apr. 28, 2017, 3 pages.

* cited by examiner

COLLAPSIBLE ALL-TERRAIN COT OR TENT APPARATUS

CROSS-REFERENCE TO RELATED APPLICATIONS

This application relies on the disclosure of and claims priority to and the benefit of the filing date of U.S. Provisional Application No. 62/290,312, filed on Feb. 2, 2016, the disclosure of which is hereby incorporated by reference herein in its entirety.

BACKGROUND OF THE INVENTION

Field of the Invention

The present invention is directed to a lightweight, packable, all-terrain cot that is designed to fit a multitude of configurations for use in different terrain situations. The invention does not have to be a cot, but can also be used as a tent, table, storage solution, or other structure.

Description of Related Art

Currently existing lightweight, packable cots require flat or almost flat ground, thereby limiting potential campsites. These cots require flat ground because they typically use at least six support points with the ground. If these support points are modified to compensate for uneven or sloping ground, the lightweight and/or packable aspects of the cots are quickly lost, another limiting aspect of the prior art; moreover, stability in these alternative configurations is far from adequate and results in cot "wobble." The invention taught herein is unique in that it is designed so that it only requires support on the corners of the cot, thereby not requiring more than four support points—enhancing ease of carrying and packing—but able to be placed on uneven ground.

Using only four support points on the cot as taught herein allows for leveling of the cot in almost any terrain. For example, a user may put a nylon strap around a tree and hang one end of the cot from straps while resting the other end on the ground. Alternatively, a user may use four small legs to support each corner on level ground. In another aspect, a user may use rocks, pieces of wood, shoes, or any other mostly solid object to support each corner as needed, or if a user does not want to carry the legs during, for example, a hike to save room and/or weight. The legs may also be adjustable.

Due to the invention as compared to the prior art, a user may now sleep as comfortably on even a 45-degree slope or more as was previously only possible on level ground.

SUMMARY OF THE INVENTION

In one embodiment of the present invention, an apparatus and method is provided that provides for assembly of a portable, lightweight, packable, all-terrain cot that is designed to fit a multitude of configurations for use in different terrain situations in three basic steps:

a. Assembling the cot;
b. Installing the cables and support assembly;
c. Providing support for the cot using, by way of example, legs, adjustable legs, other mostly solid object, tree, or other available supporting structure.

In a preferred embodiment, the capabilities of the cot are made possible by using opposing arches resulting in an innovative cot apparatus that is superior to the prior art. An arch provides excellent structural strength and enables use of lightweight materials; in a preferred embodiment, 1/16" aluminum for all or portions of the frame. To work, an arch should be somewhat rigid, forces should be mostly in line with the arch and the ends of the arch should preferably not move to a degree that affects structural integrity and/or comfort. As an example, an arch bridge illustrates the in-line forces—in a bridge, the arch is pointed up to support the forces from the cars and weight of the bridge that are going straight down. However, for a cot, the forces on the sides of the cot are not going straight down, rather they are going to a point defined by the bottom of the canvas (or other material) support when weight is applied. Consequently, tilting the arch at a small angle (about 18-20 degrees, in one aspect) aligns the arch with the forces that are acting on the sides of the cot. The arch tends to want to flatten out when used. A bridge has abutments built into bedrock to prevent that. In the present invention, one or more or a single inside cable on each side is taught to prevent the arch from flattening and becoming ineffective. The outside cables are used to keep the arch at the correct angle. When weight is applied, the arch wants to tilt up, so an appropriately placed cable is taught to prevent that. When a user is using the cot, the user may grab the arch to get on or off, or they may shift their weight while sleeping, so the other cable on the outside keeps the arch from failing or otherwise becoming compromised.

In one aspect, Aspect 1, the invention is a collapsible apparatus comprising:

(i) a head bar, a tail bar, and at least two arch rods;
  wherein each of the arch rods are curved;
  wherein the head bar and the tail bar each comprise two or more holes shaped and sized to receive an end of one of the arch rods;
  wherein, during use, the arch rods are disposed between the head bar and the tail bar with concave surfaces facing one another;

(ii) a set of cables configured for attachment with the head bar and the tail bar in a manner to provide tension between the head bar and the tail bar, such that during use the arch rods are arched under tension to support weight on the apparatus; and (iii) a sheet of material configured for attachment to the arch rods to provide a surface for a user during use.

Aspect 2 is the collapsible apparatus of Aspect 1, wherein during use the sheet of material is under tension between the arch rods to provide a taut surface for a user.

Aspect 3 is the collapsible apparatus of Aspects 1-2, further comprising one or more adjustable straps in operable communication with the head bar, which straps provide for coupling of the head bar to a support structure for maintaining the sleeping surface of the sheet of material in a desired position relative to the ground during use.

Aspect 4 is the collapsible apparatus of Aspects 1-3, wherein the sheet of material is configured for attachment to the arch rods by way of a pocket disposed lengthwise along an edge of the sheet of material, which pocket is shaped and sized for receiving one of the arch rods, and a pocket along each end of the sheet of material which is shaped and sized for receiving one of the head or tail bars.

Aspect 5 is the collapsible apparatus of Aspects 1-4, wherein the sheet of material is configured for attachment to the arch rods by way of a hook and loop fastener and/or snaps.

Aspect 6 is the collapsible apparatus of Aspects 1-5, wherein each of the arch rods comprises multiple pieces to enable the arch rods to be broken down for packing and transportation.

Aspect 7 is the collapsible apparatus of Aspects 1-6, wherein the head bar and/or tail bar have a hollow interior configured to allow for nesting of one or more of the multiple pieces of the at least two arch rods inside the head bar and/or tail bar for storage and/or transportation.

Aspect 8 is the collapsible apparatus of Aspects 1-7 comprising a security strap configured to deter the collapsible apparatus from moving front to back, side to side, and/or diagonally during use.

Aspect 9 is the collapsible apparatus of Aspects 1-8 comprising one or more support legs in communication with or configured to be capable of communicating with the tail bar and/or the head bar for supporting the collapsible apparatus on a support structure or the ground.

Aspect 10 is the collapsible apparatus of Aspects 1-9 comprising an optional shelter structure shaped and sized to cover part or all of the surface during use.

Aspect 11 is the collapsible apparatus of Aspects 1-10, wherein the set of cables comprises at least six cables, with two inner cables and four outer cables.

Aspect 12 is the collapsible apparatus of Aspects 1-11, wherein the inner cables provide tension for maintaining curvature of the arch rods and the outer cables maintain the arch of the arch rods in order to support weight applied to the apparatus.

Aspect 13 is the collapsible apparatus of Aspects 1-12 comprising adjustment knobs and/or a ratcheting buckle for adjusting tension of one or more of the cables of the set of cables.

Aspect 14 is the collapsible apparatus of Aspects 1-13 comprising a cable support assembly for maintaining a desired spacing between one or more cables of the set of cables.

Aspect 15 is the collapsible apparatus of Aspects 1-14, wherein each of the head and tail bars are curved and the head bar and the tail bar are disposed with convex surfaces facing one another.

Aspect 16 is the collapsible apparatus of Aspects 1-15, wherein during use the sheet of material is under tension between the arch rods and the head and tail barsend bars to provide a taut surface for a user.

Once the cot is assembled, support in terrain is provided.

If using a tree as support, a multi-step process may be used:

1) Attach hanging strap to tree and place ends around end pieces;
2) Attach security strap to tree (keeps it from moving left/right, front/back, and diagonally);
3) Insert legs at end opposite tree (optional). Preferably, the legs are not resting on a slick surface. If the legs slide out from under the cot, damage might occur;
4) If needed, adjust length of straps from tree to make level;
5) If using legs on level ground, install preferably short legs as taught herein, or adjustable legs.

BRIEF DESCRIPTION OF THE DRAWINGS

The accompanying drawings illustrate certain aspects of embodiments of the present invention, and should not be used to limit the invention. Together with the written description the drawings serve to explain certain principles of the invention. A wide variety of potential embodiments will be more readily understood through the following detailed description of certain exemplary embodiments, with reference to the accompanying exemplary drawings in which.

DETAILED DESCRIPTION OF VARIOUS EMBODIMENTS OF THE INVENTION

Certain exemplary embodiments provide an apparatus, such as a cot or tent, that can be releasably coupled to a structure such as a tree or used by itself on level ground or ground that is not level. Another embodiment is a system that utilizes structural qualities of the arch for both vertical and lateral support, offering a surface, such as a sleeping surface, without the requirement, in a preferred embodiment, for middle frame support found on certain traditional cots. Using an arch also enables the apparatus taught herein to be built from lightweight materials, enabling enhanced packability and portability. In one aspect, wire cables are used to restrain the arch from flattening, to adjust tension, and to keep the arch at a specific angle in line with the force being applied to it. By using support on the ends corners, the apparatus provides a substantially level surface on rough or sloping ground by securing one end of the apparatus to a tree, wall, or other secure surface or object with, in one embodiment, nylon webbing, and resting the other end on the ground or attaching it to another tree, wall, or other surface. Legs, which may be adjusted, are provided for optional use for the end resting on the ground by using, for example, nylon webbing to provide structural stability. Alternatively, small adjustable legs can be used on all four corners to use the apparatus on level ground or almost level ground, which eliminates the need for a tree, wall, or other secure object.

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

Figure 1:
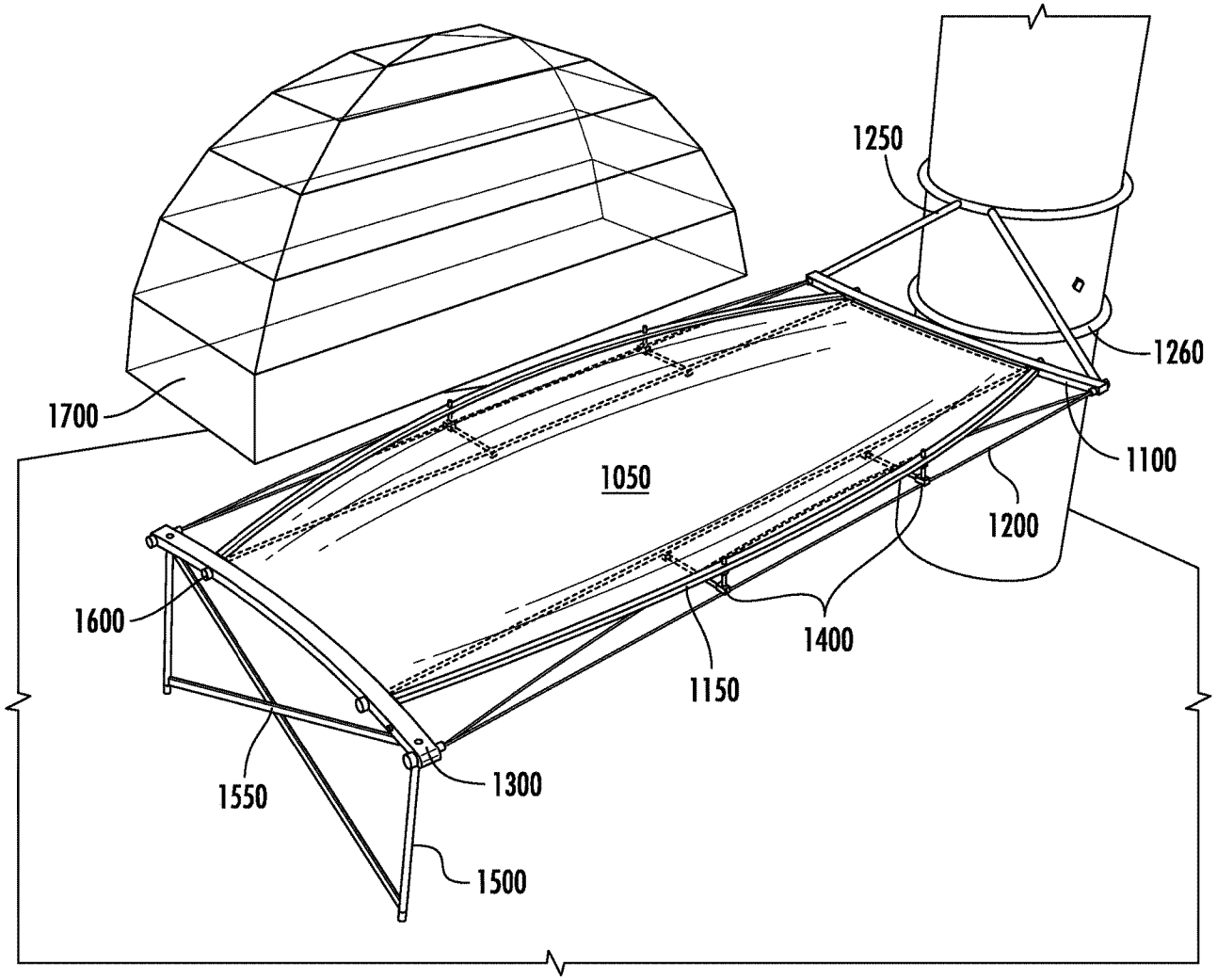
FIG. 1 is a perspective view of an exemplary embodiment of the apparatus as attached by the system of attaching the cot to a tree and stabilizing on the other end of the cot.

Turning to the figures, FIG. 1 is a perspective view of an exemplary embodiment of a system, which illustrates a preferred embodiment of the invention, specifically a cot, 1050. In this depiction the cot is attached to a tree. The cot 1050 comprises:

A head bar 1100, which can be constructed to:

have the same curved radius as the arch to allow for nesting of arch pieces 1150 inside the head bar for storage and transportation, although the head bar could be straight;

be coupled to, and function as an attachment structure for, one or more optional adjustable straps 1250 that are coupleable to a tree such that the cot 1050 is held, in a preferred embodiment, horizontally or almost horizontally above ground level;

be coupled to, and function as an attachment structure for, one or more cot arch rods 1150, which restrains the cot 1050 from folding or deflecting beyond a distance which would cause collapse or other critical compromising of structural integrity such that the purpose of the apparatus would not be adequately fulfilled when a weight (e.g., a person) is placed on the cot 1050. Each of the arch rods can be broken down into multiple pieces to facilitate ease of packing and transportation. Two of these pieces could fit in the head bar 1100 and two pieces in the tail bar 1300 (see FIG. 7, for example);

be coupled to, and function as an attachment structure for, a security strap 1260 to be used when hanging from a tree or other similar support in order to prevent the cot from moving to an unacceptable degree, for example, front to back, side to side, or diagonally, for its intended purpose;

be coupled to, and function as an attachment structure for, one or more optional adjustable support legs (see 1500 in FIG. 1 or 1510 in FIG. 2, for exemplary aspects) for use on ground or other solid or mostly solid objects;

be coupled to, and function as an attachment structure for, a set of cables 1200 that strengthen and/or maintain the shape and position of the arch structure to support a weight, such as a person, that is on the apparatus 1050; and/or be coupled to, and function as an attachment structure for, an optional shelter 1700 to cover the cot.

A set of cables 1200 in an embodiment comprises two single inside cables to keep the respective arches 1150 from collapsing or flattening out. Tension for the cot surface can be increased or decreased using the adjustment knobs 1600 (or ratcheting buckle, shown as an alternative in FIG. 6). Increasing the tension stiffens the sleeping surface. The two outside cables which consist of an upper and lower cable ensure that the arch is maintained at such an angle to keep the arch in line or adequately in line with the forces being applied to it. The cable support assemblies 1400 ensure the cables stay in the proper position.

A set of cable support assemblies 1400 is provided to maintain spacing between a set of cables 1200 and thereby provide additional structural stability to system 1000, as well as two cot arch rods 1150.

A tail bar 1300 is provided, which can be constructed to:

have the same curved radius as the arch rod to allow for nesting of arch pieces inside the tail bar for storage and transportation, although the tail bar could be straight;

be coupled to, and function as an attachment structure for, one or more legs 1500 or 1510;

be coupled to, and function as an attachment structure for, set of cables 1200 that support an arch structure to support a weight, such as a person, that is on the apparatus 1050;

be coupled to, and function as an attachment structure for, arch rods 1150;

be coupled to, and function as an attachment structure for, an optional shelter 1700 to cover the cot;

be coupled to a set of straps 1550 when used with legs 1500 constructed to provide structural stability to system 1000 when a weight (e.g., a person) is on the apparatus 1050; and/or be coupled to a set of knobs 1600 (four are shown in the illustrated embodiment) at the end of the cot which are used to adjust cable tension. Alternatively a small, lightweight ratcheting buckle could be used to adjust cable tension (see FIG. 6).

Figure 2:
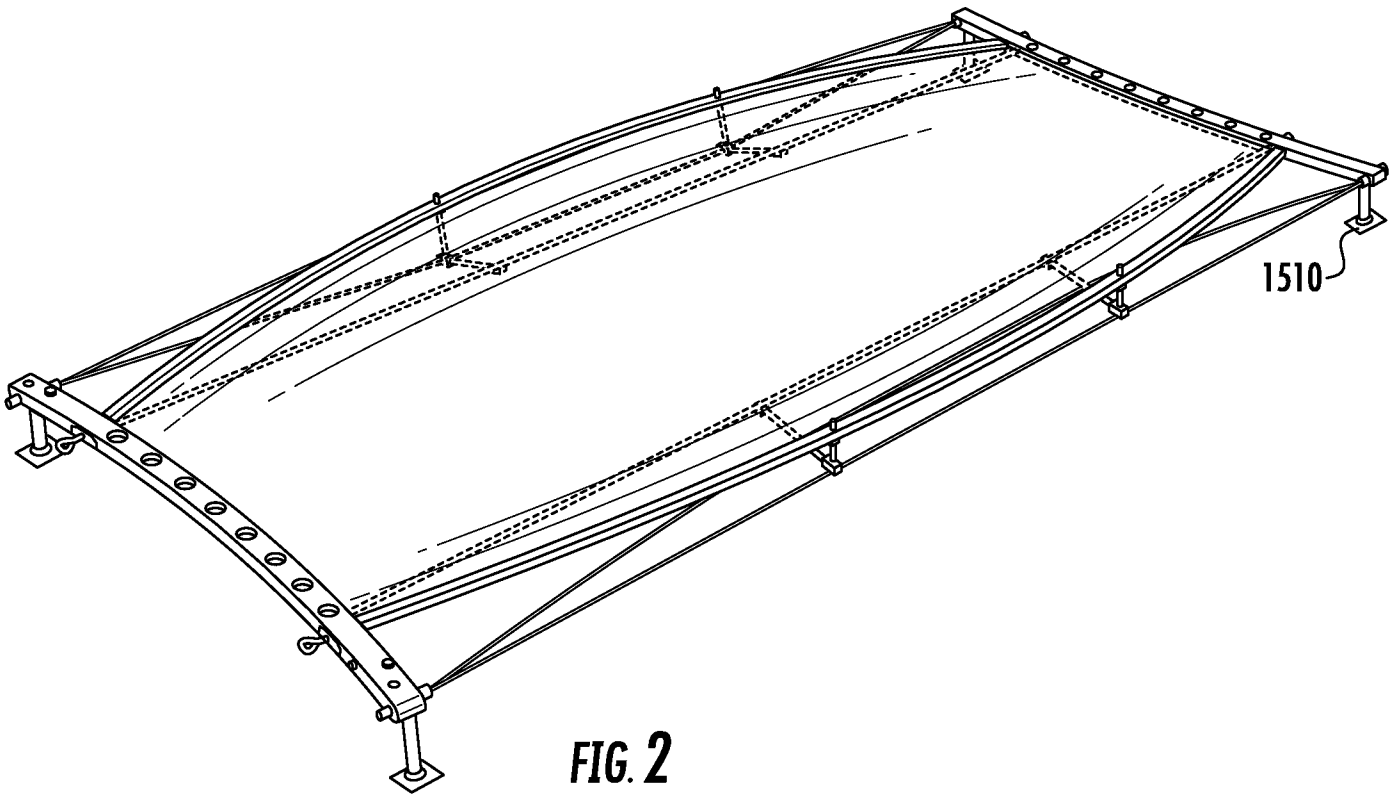
FIG. 2 is a depiction showing the cot with legs, which may be adjustable, on level ground. This figure also demonstrates optional machining done to the head and tail bars to reduce overall weight of the cot (see, e.g., holes in top of head bar and tail bar)

FIG. 2 is an illustration of an exemplary embodiment of a system using short legs 1510 for placing on a flat or mostly flat surface. Alternatively, one or more corners of the cot could be supported by solid or mostly solid objects (e.g., rocks) and the short legs would not need to be used, or the legs can be adjustable.

Figure 3:
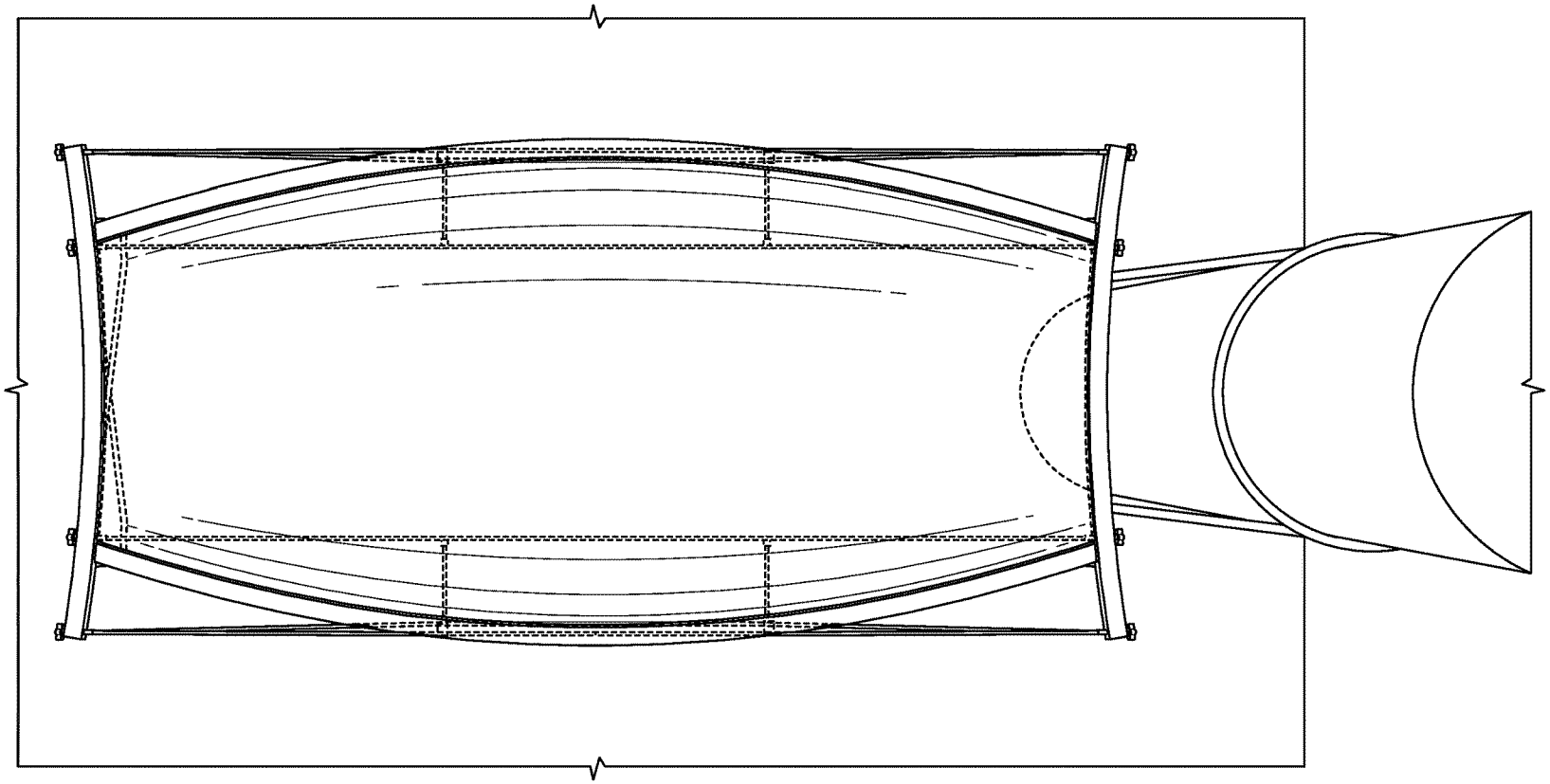
FIG. 3 is an image of the cot from above showing preferably arched end pieces.

FIG. 3 is an illustration of the apparatus attached to a tree as viewed from a bird's eye view.

Figure 4:
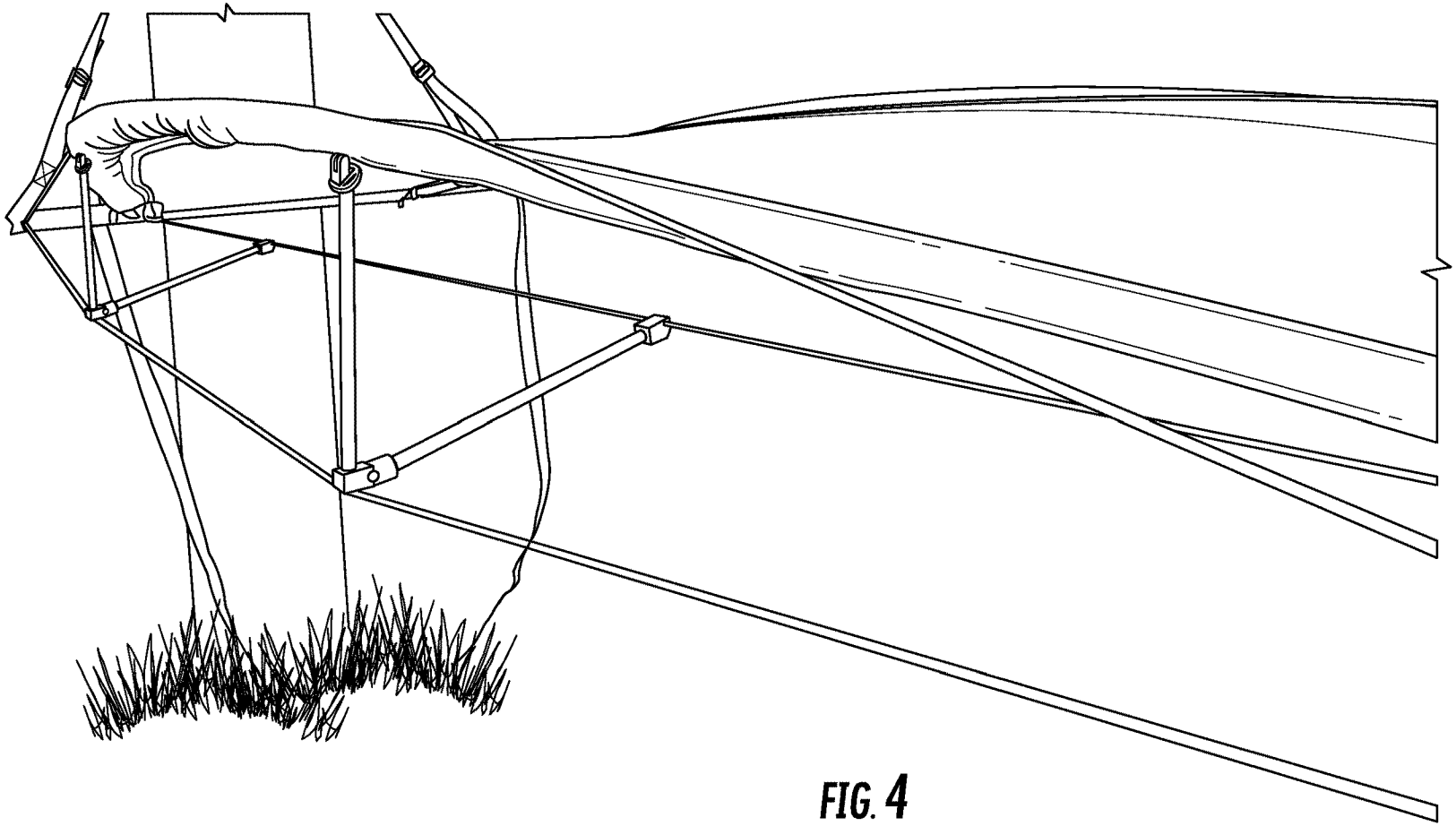
FIG. 4 is a close-up depiction of the cot showing the cables and cable support assembly.

FIG. 4 is a close-up illustration of the arches, cables, and cable support assemblies of an exemplary embodiment of the apparatus coupled to a tree.

Figure 5:
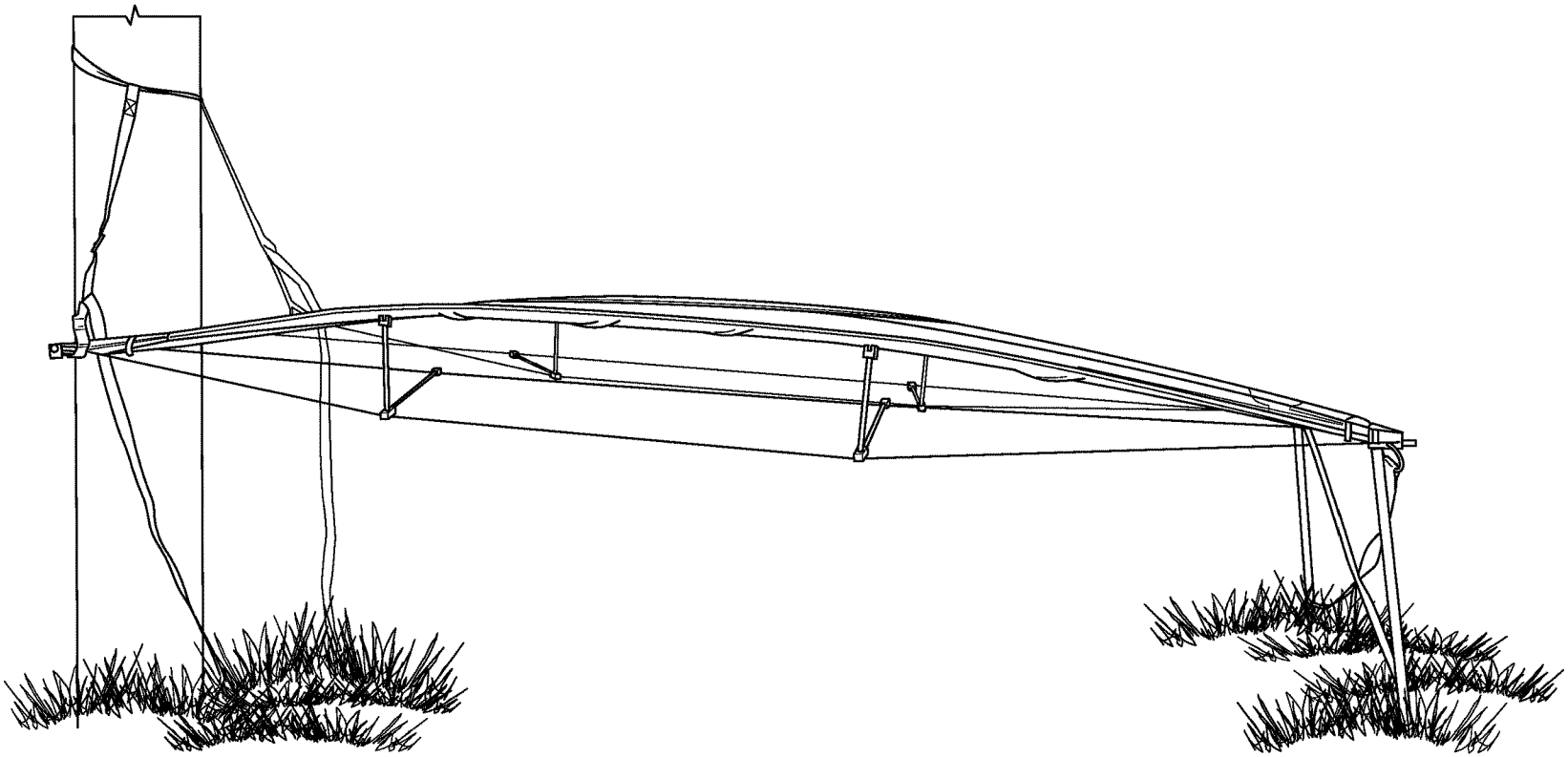
FIG. 5 shows a side view of the cot attached to a tree on one end.

FIG. 5 is a side-view illustration of an exemplary embodiment of the apparatus coupled to a tree with optional legs 1500 attached.

Figure 6:
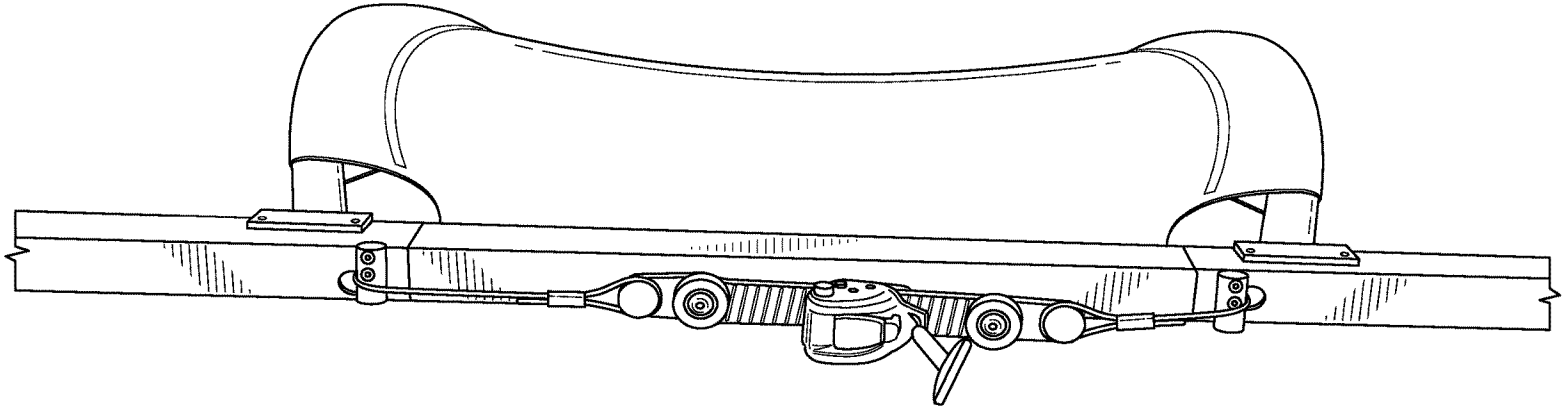
FIG. 6 is a depiction showing the ratcheting buckle which is an alternative to the cable adjustment knobs.

FIG. 6 is a close-up showing the ratcheting buckle which is an alternative to the cable adjustment knobs.

Figure 7:
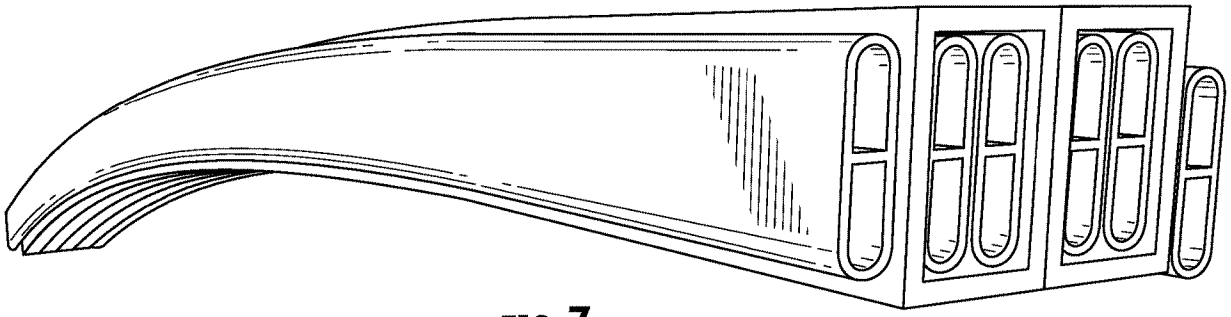
FIG. 7 demonstrates how the two arch rods 1150 would be broken down and nested in the head bar 1100 and tail bar 1300.

FIG. 7 shows a preferred embodiment of two cot arch rods 1150, each of which can be broken down into multiple pieces, in this example three pieces. In a preferred embodiment, two of these pieces could fit in the head bar 1100 and two pieces in the tail bar 1300. This is an example of how the frame of the cot can be broken down and stored to minimize volume while packed.

Figure 8:
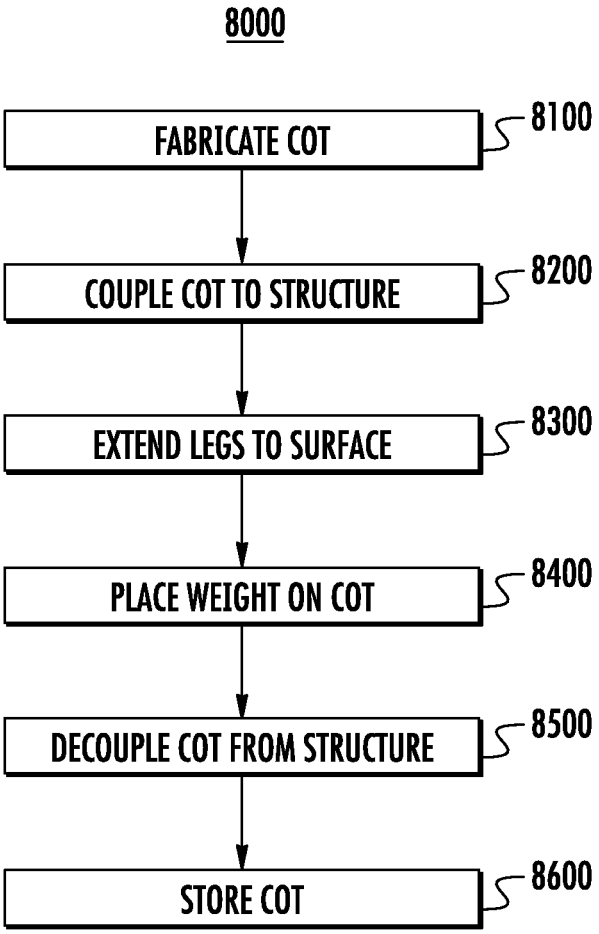
FIG. 8 is a flowchart of an exemplary embodiment of a method of assembling and later storing the apparatus.

FIG. 8 is a flowchart of an exemplary embodiment of a method 8000. At activity 8100, a cot can be assembled. At activity 8200, the cot can be coupled to a structure for use by a person. The structure can be a tree, pole, post, rock, and/or building, etc. The cot can also be used without attaching one end to a structure, such as using legs or placing some object under each corner to lift it off the surface a few inches (e.g., rocks, logs, or other structures).

At activity 8300, legs of the cot can be extended to contact a surface. The surface can be the surface of the earth, a floor, and/or a structure constructed to elevate the cot to some elevation above ground level. At activity 8400, a weight can be placed on the cot. For example, a person can lay on the cot and/or materials and supplies can be placed on the cot to keep them above ground level.

At activity 8500, the cot can be decoupled from the structure. When decoupled the cot can be disassembled and/or folded for storage. At activity 8600, the cot can be stored until further use is desired.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof.

adapter—a device used to effect operative compatibility between different parts of one or more pieces of an apparatus or system.

and/or—either in conjunction with or in alternative to.

apparatus—an appliance or device for a particular purpose.

associate—to join, connect together, and/or relate.

can—is capable of, in at least some embodiments.

configure—to make suitable or fit for a specific use or situation.

connect—to join or fasten together.

constructed to—made to and/or designed to.

convert—to transform, adapt, and/or change.

coupleable—capable of being joined, connected, and/or linked together.

coupling—linking in some fashion.

define—to establish the outline, form, or structure of.

determine—to obtain, calculate, decide, deduce, and/or ascertain.

device—a machine, manufacture, and/or collection thereof.

install—to connect or set in position and prepare for use.

may—is allowed and/or permitted to, in at least some embodiments.

method—a process, procedure, and/or collection of related activities for accomplishing something.

plurality—the state of being plural and/or more than one.

predetermined—established in advance.

provide—to furnish, supply, give, and/or make available.

receive—to get as a signal, take, acquire, and/or obtain.

set—a related plurality.

substantially—to a great extent or degree.

support—to bear the weight of, especially from below.

system—a collection of mechanisms, devices, machines, articles of manufacture, processes, data, and/or instructions, the collection designed to perform one or more specific functions.

via—by way of and/or utilizing.

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive.

The invention claimed is:

1. A collapsible apparatus comprising:

(i) a head bar, a tail bar, and at least two arch rods;

wherein the at least two arch rods are disposed between the head bar and the tail bar;

wherein the head bar and the tail bar each comprise two or more holes shaped and sized to receive an end of one of the arch rods;

wherein the at least two arch rods are disposed between the head bar and the tail bar with concave surfaces facing one another, and wherein the at least two arch rods are angled away from horizontal;

(ii) a set of cables configured for attachment with the head bar and the tail bar in a manner to provide tension between the head bar and the tail bar, such that during use the arch rods are arched under vertical, lateral, and/or diagonal tension to support weight on the apparatus; and (iii) a sheet of material configured for attachment to the arch rods to provide a surface for a user during use.

2. The collapsible apparatus of claim 1, wherein during use the sheet of material is under tension between the arch rods.

3. The collapsible apparatus of claim 1, further comprising one or more adjustable straps in operable communication with the head bar, which straps provide for coupling of the head bar to a support structure for maintaining the surface of the sheet of material in a desired position relative to the ground during use.

4. The collapsible apparatus of claim 1, wherein each of the at least two arch rods comprises multiple pieces to enable the arch rods to be broken down for packing and transportation.

5. The collapsible apparatus of claim 1 comprising a security strap configured to deter the collapsible apparatus from moving front to back, side to side, and/or diagonally during use.

6. The collapsible apparatus of claim 1 comprising one or more support legs in communication with or configured to be capable of communicating with the tail bar and/or the head bar for supporting the collapsible apparatus on a support structure or the ground.

7. The collapsible apparatus of claim 1 comprising a shelter structure shaped and sized to cover part or all of the surface during use.

8. The collapsible apparatus of claim 1, wherein the set of cables comprises at least six cables, with two inner cables and four outer cables.

9. The collapsible apparatus of claim 8, wherein the inner cables provide tension for maintaining curvature of the at least two arch rods and the outer cables maintain the arch of the at least two arch rods in order to support weight applied to the apparatus.

10. The collapsible apparatus of claim 1 comprising adjustment knobs and/or a ratcheting buckle for adjusting tension of one or more of the cables of the set of cables.

11. The collapsible apparatus of claim 1 comprising a cable support assembly for maintaining a desired spacing between one or more cables of the set of cables.

12. The collapsible apparatus of claim 1, wherein during use the sheet of material is under tension between the at least two arch rods and the head and tail bars.

13. The collapsible apparatus of claim 1, further comprising one or more adjustable straps in operable communication with the tail bar, which straps provide for coupling of the tail bar to a support structure for maintaining the surface of the sheet of material in a desired position relative to the ground during use.

14. A collapsible apparatus comprising:

(i) a head bar, a tail bar, and at least two arch rods;
wherein the at least two arch rods are disposed between the head bar and the tail bar;
wherein the head bar and the tail bar each comprise two or more holes shaped and sized to receive an end of one of the arch rods;
wherein the at least two arch rods are disposed between the head bar and the tail bar with concave surfaces facing one another, and wherein the at least two arch rods are angled away from horizontal;
wherein each of the at least two arch rods comprises multiple pieces to enable the at least two arch rods to be broken down for packing and transportation;
wherein the head bar and/or tail bar have a hollow interior configured to allow for nesting of one or more of the at least two arch rods or multiple pieces of the at least two arch rods inside the head bar and/or tail bar for storage and/or transportation;

(ii) a set of cables configured for attachment with the head bar and the tail bar in a manner to provide tension between the head bar and the tail bar, such that during use the arch rods are arched under vertical, lateral, and/or diagonal tension to support weight on the apparatus; and (iii) a sheet of material configured for attachment to the arch rods to provide a surface for a user during use.

15. A collapsible apparatus comprising:

(i) a head bar, a tail bar, and at least two arch rods;
wherein the at least two arch rods are disposed between the head bar and the tail bar;
wherein the head bar and the tail bar each comprise two or more holes shaped and sized to receive an end of one of the arch rods;
wherein the at least two arch rods are disposed between the head bar and the tail bar with concave surfaces facing one another, and wherein the at least two arch rods are angled away from horizontal;
wherein each of the head and tail bars are curved and the head bar and the tail bar are disposed with convex surfaces facing one another;

(ii) a set of cables configured for attachment with the head bar and the tail bar in a manner to provide tension between the head bar and the tail bar, such that during use the arch rods are arched under vertical, lateral, and/or diagonal tension to support weight on the apparatus; and (iii) a sheet of material configured for attachment to the arch rods to provide a surface for a user during use.

* * * * *